US006802161B1

(12) United States Patent
Robinson

(10) Patent No.: US 6,802,161 B1
(45) Date of Patent: Oct. 12, 2004

(54) SEALING MEMBER

(76) Inventor: Gerard Francis Robinson, 26 Upper Churchtown Road, Dublin 14 (IE)

( * ) Notice: Subject to any disclaimer, the term of this patent is extended or adjusted under 35 U.S.C. 154(b) by 0 days.

(21) Appl. No.: 09/786,255

(22) PCT Filed: Sep. 8, 1999

(86) PCT No.: PCT/IE99/00092

§ 371 (c)(1),
(2), (4) Date: Mar. 2, 2001

(87) PCT Pub. No.: WO00/14350

PCT Pub. Date: Mar. 16, 2000

(30) Foreign Application Priority Data

| | | |
|---|---|---|
| Sep. 8, 1998 | (GB) | 9819460 |
| Nov. 12, 1998 | (IE) | S980935 |
| Nov. 13, 1998 | (GB) | 9824812 |
| Apr. 15, 1999 | (GB) | 9908494 |

(51) Int. Cl.[7] ..... E04B 2/00

(52) U.S. Cl. ..... 52/287.1; 52/288.1

(58) Field of Search ..... 52/287.1, 288.1

(56) References Cited

U.S. PATENT DOCUMENTS 3,966,379 A * 6/1976 O'Brien ..... 425/327

FOREIGN PATENT DOCUMENTS

| | | |
|---|---|---|
| CH | 660615 | 5/1987 |
| GB | 2136288 | 9/1984 |
| GB | 2289924 | 12/1995 |
| GB | 2322644 | 9/1998 |
| WO | 9840234 | 9/1998 |

* cited by examiner

*Primary Examiner*—Carl D. Friedman
*Assistant Examiner*—Nahid Amiri

(57) ABSTRACT

Sealing member (10) is adapted to be installed independently or as a component of a sealing assembly, to maintain a sealed joint between relatively vertical and horizontal surfaces (A & B) either as a straight linear or corner joint. The sealing member (10) has a first upper limb (11) for contacting the vertical surface (A) and a second outer limb (12) for containment of sealing material (27) on the horizontal surface (B). Lower face (17) of limb (12) and/or inner face (20) of upper limb (11) are wholly or partially layered with an anti-adherent material (13) to act as shuttering between the seal member (10) and the sealing materials.

10 Claims, 7 Drawing Sheets

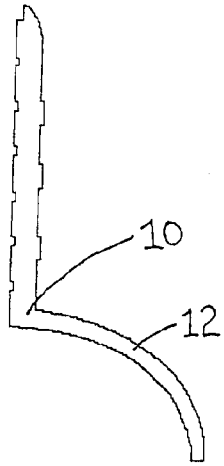
FIG. 21
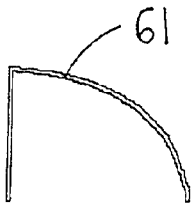
FIG. 22
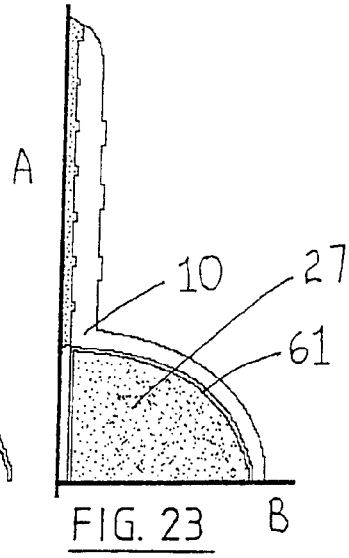
FIG. 23
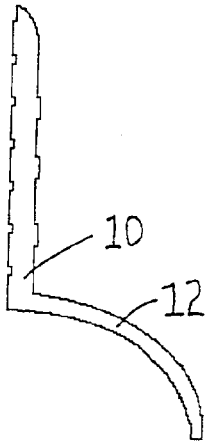
FIG. 24
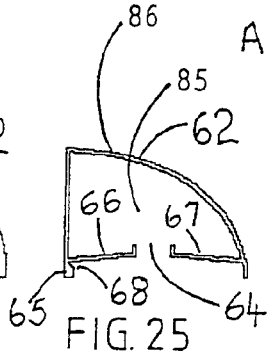
FIG. 25
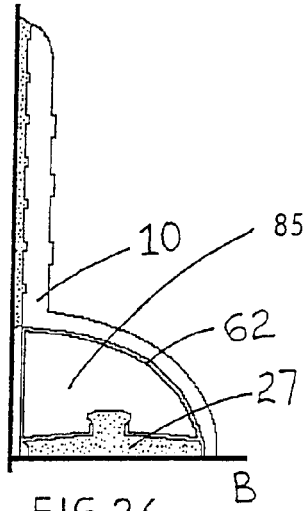
FIG. 26
FIG. 27
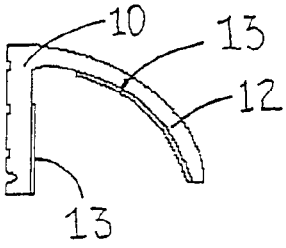
FIG. 28
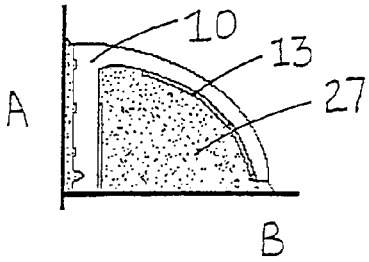

SEALING MEMBER

The present invention relates to a seal for sealing the joint between two contiguous surfaces disposed at an angle to each other, such as, but not limited to the horizontal joint between a tiled wall and a shower tray or bath.

The main prior art methods of sealing the junction of walls and horizontal surfaces (such as shower trays, baths and worktops) are as follows.

METHOD A: Semi-rigid (typically uPVC) quadrant or scotia type profile sealing strips, with or without additional components, that have soft butyl rubber sealing lips attached to the upper most and/or outer most boundaries, are surface mounted onto, or partially recessed into the wall surface, to form a seal with horizontal surfaces.

METHOD B: A sealant material (typically silicone, acrylic, or latex based) is extruded into or over the horizontal or vertical joint METHOD C: Quadrant tiles are laid over the horizontal or vertical joint.

METHOD D: The receptacle may have an upstanding flange attached to the outermost boundary that is partially recessed into the wall and tiled over.

METHOD E: A flexible silicone/Upvc based tape has a peel off paper back adhesive strip (typically butyl rubber) attached to the inner face. The tape has a score line indicating the bending location. The peel off paper is removed and laid onto each surface defining the joint.

METHOD F: Two interlocatable strips are profiled for installation onto two adjacent surfaces respectively. A third strip may be introduced to aid installation.

The main disadvantages of the above arrangements are that in the case of prior art method A, soft lips perish, shrink, harden and leak in shower areas. In the case of prior art method B the exposed sealant is unsightly. In the case of prior art methods A, E and F the corner details are poor, in some cases the sealing extrusions are just butt jointed rigidly with glue and/or mitre supports and/or comer moulds, and when differential joint movement occurs, these joints may leak, repairs arc awkward as existing surfaces are contacted, and the bonding of additional sealing materials is difficult. In the case of prior art method E, the strips are generally regarded as having a short life span.

It is the object of this invention to provide a sealing member that may readily installed, and adapted to overcome or substantially reduce the aforementioned problems.

WO-A-98 40284 discloses a sealing assembly which is adapted to maintain a sealed joint between vertical and horizontal surfaces. The assembly comprises a wall trim, side trim and side mitre pieces. An elastic sealing material is located between the wall trim and the horizontal surface and can compensate for differential horizontal surface movement.

WO-A-98 40284 discloses a sealing assembly which is adapted to maintain a sealed joint between vertical and horizontal surfaces. The assembly comprises a wall trim, side trim and side trim mitre pieces. An elastic sealing material is located between the wall trim and the horizontal surface and can compensate for differential horizontal surface movement.

According to the present invention there s provided a sealing member adapted to be installed independently or as a component of a sealing assembly, to maintain a sealed joint between relatively vertical and horizontal surfaces, being either straight linear or comer joints, the sealing member comprising a first substantially rigid limb having an upper boundary and a lower boundary between which there extends on each side of the limb an inner face and an outer face, the outer face of which is adapted wholly or in part to be fixed and/or sealed to the relatively vertical surface, and from which inner face upper boundary or lower boundary there extends at least one second substantially rigid limb having an inner boundary and an outer boundary, the inner boundary of which is attached to the inner face upper boundary and/or lower boundary of the first limb, and between which inner and outer boundaries there extends on each side of the second limb an upper face and a lower face, the lower face of which is adapted wholly or in part to be sealed to the relatively horizontal surfaces, and/or accommodate and retain a sealing material between the said second limb lower face and the horizontal surface, characterized in that the first limb inner face and/or the second limb lower face is wholly or in part layered with an anti-adherent material to form a releasable shuttering for the sealing material in the cavity formed between the first limb inner face and/or the second limb lower face and the adjacent horizontal surface, thereby providing a continuous up-standing containment cavity for the applied sealing material that will form a boundary wall bonded to the horizontal surface, yet wholly or partially independent and/or releasable from the seal member to which initially attached.

Optionally the anti-adherent material is typically though not exclusively a polythene tape, and/or an anti-stick film spray, and/or a co-extruded material and/or a complementary extrusion.

Optionally the sealing material is typically though not exclusively, independently or in combination, a silicone and/or a complementary extrusion and/or a butyl tape and/or a sealant material.

In a first embodiment the anti-adherent material is a polythene tape coated on one side with pressure sensitive adhesive that bonds the tape onto surfaces of seal member desired not to form a bond with the sealing material or parts there of.

In a second embodiment the anti-adherent material may be an extrusion adapted to be layered against the seal member to form a shuttering between the sealing material and those surfaces of seal member desired not to form a bond with the sealant material.

Advantageously an extrusion may be adapted to be employed simultaneously as a part sealing material and an anti-adherent material.

Preferably a substantially three sided extrusion employed both as a part sealing material and an anti-adherent material, may be adapted through the provision of an longitudinal channel along it's lowermost side to conserve and/or restrict the volume of sealing material used.

Alternatively an extrusion employed both as a part sealing material and an anti-adherent material is adapted through the provision of at least one tare away strip attached to the lowermost face to be adjustably positioned on a surface, as the seal member may require.

Optionally an extrusion adapted to be employed both as a part sealing material and an anti-adherent material may be adapted to form a key or bond between the lower face and the sealing material through the provision of ribs and/or recesses along the outer lowermost face.

Preferably the first and/or second limbs of the seal member are adapted to drain off water that may fall there on and/or engage complementary seal members.

The outside face of the first limb has a plurality of ridges and/or recesses and/or contact points and/or holes to accommodate fixing and/or sealing adhesive materials.

If desired the height of the first limb may be reduced through the provision of at least one weakening score line, defining a longitudinal area along the lower boundary that may be easily removed, to determine the gap between outer boundary of the second limb and a second surface.

The second limb profile is wholly and/or in any series combination, convex and/or concave and/or planer.

Optionally from the junction where the first limb meets second limb, the sectional thickness of second limb is suitable reduced as it extends to it's outer boundary to allow flexible movement against the sealing materials.

In another embodiment a third limb extends out from the first limb and below the second limb, to conserve and/or restrict the volume of sealing material used.

Optionally the connection between the first limb and the second limb is flexibly adapted to accommodate the retro-application of a sealing material under and/or behind the second limb and/or accommodate lateral movement of the sealing material away from the first limb.

In another embodiment the second limb is partially adapted to extend back onto or above the first limb to encompass a sealant reservoir against the first limb or vertical surface, and overlap the sealant reservoir encompassed between the first limb and/or the second limb and the horizontal surface.

Optionally the upper seal member boundary is adapted to be engaged between the vertical surface and an applied covering, and/or adapted to support said applied covering.

If desired the said adapted supporting upper seal member boundary may be optionally removed through the provision of at least one weakening score line below the said adaptation, defining a longitudinal area that may be easily removed.

Advantageously, a third limb extends from the outer face of the first limb with the lower face of the third limb being coated with an anti-adherent material.

In a further embodiment of this invention two seal members may be inter connected and/or complementarily profiled to seal the joint between two adjacent surfaces.

The invention will hereinafter be more particularly described with reference to the accompanying drawings, which show by way of example only, embodiments of the seal according to the invention, in these drawings.

Figure 15:
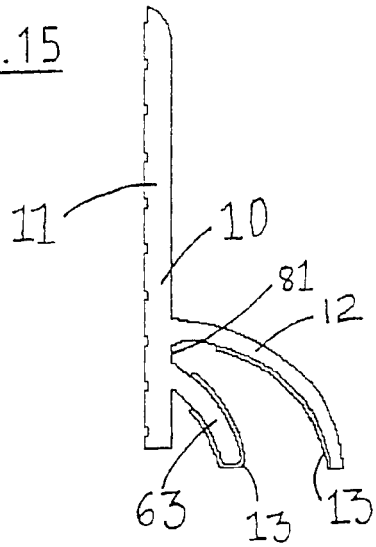
Figure 18:
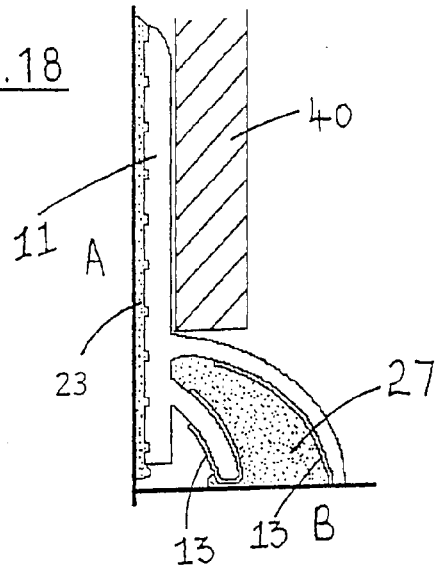
Figure 16:
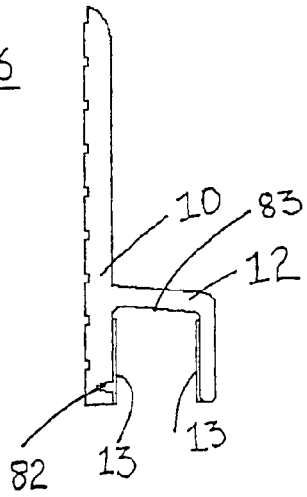
Figure 19:
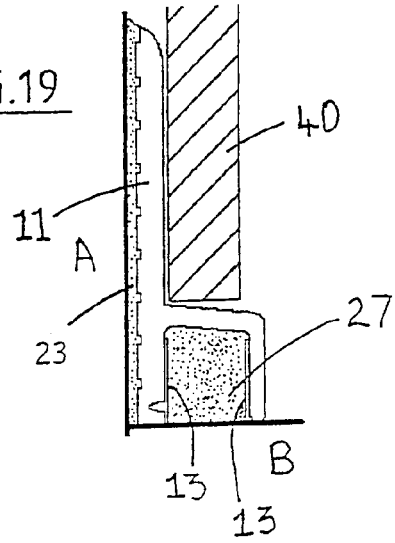
Figure 17:
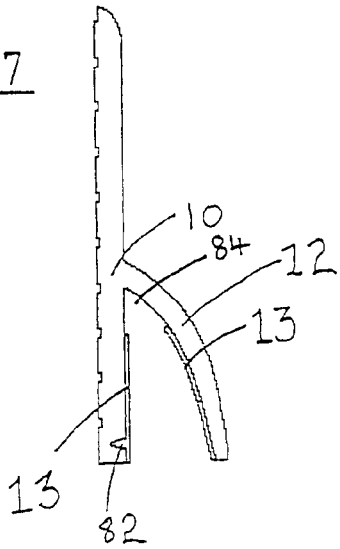
Figure 20:
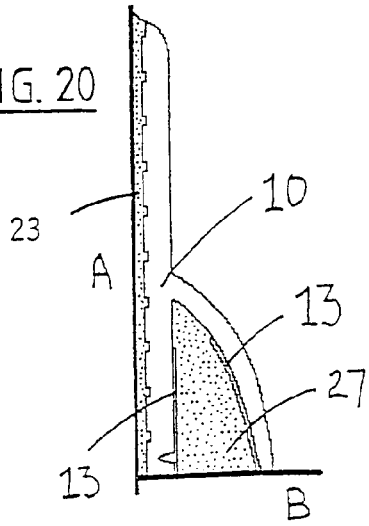
Figure 29:
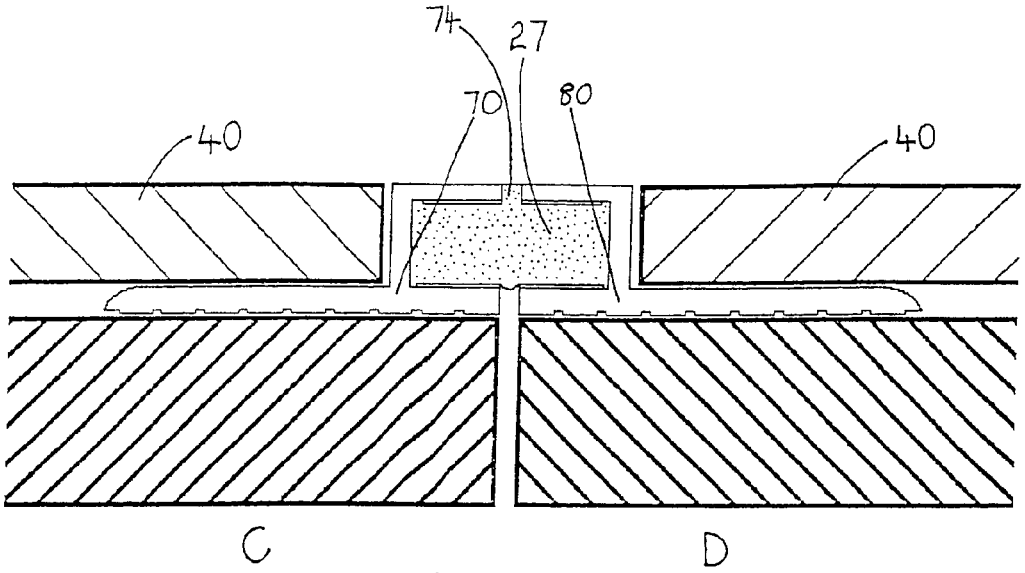
Figure 30:
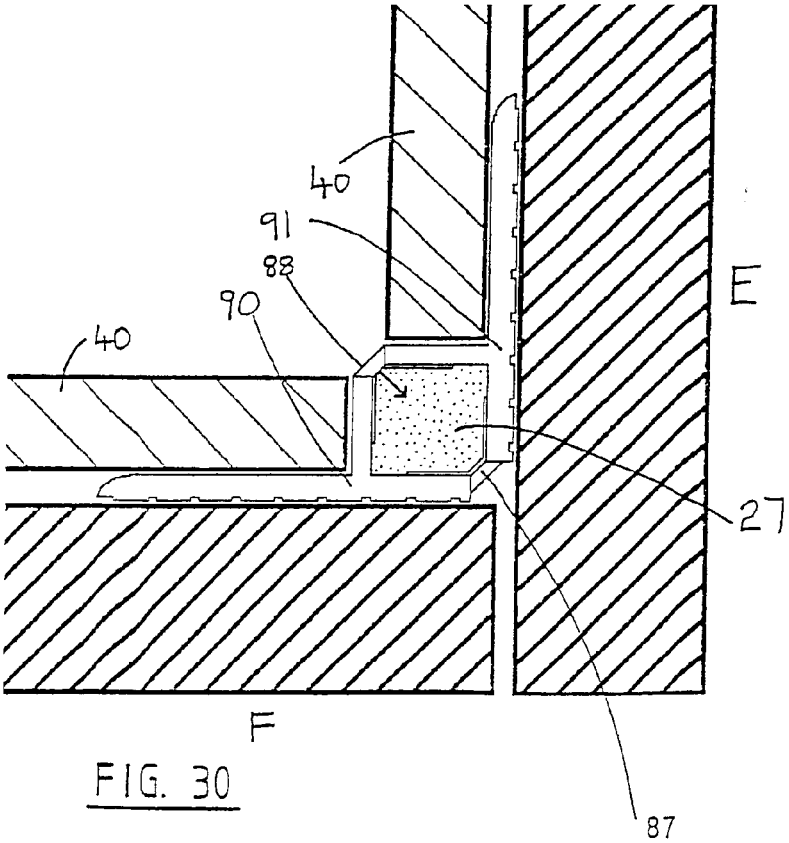
Figure 31:
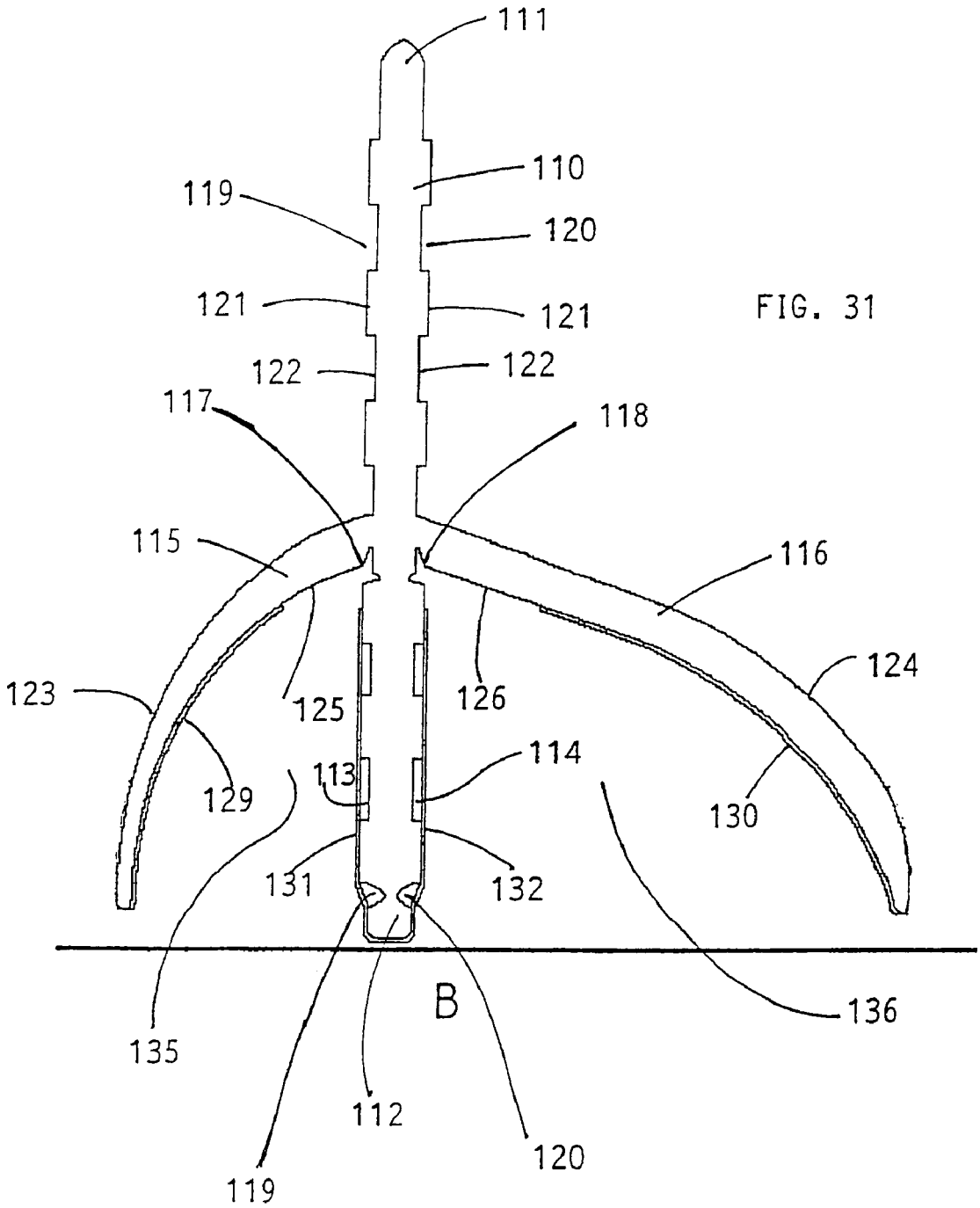

FIG. 15, 16, and 17 represent sectional views of three further alternate embodiments of the sealing member according to the current invention;

FIGS. 18, 19 and 20 represent respectively sectional views of FIGS. 15, 16 and 17 of the sealing member installed between two surfaces;

FIGS. 21 and 22 detail respectively sectional views of the sealing member and the detached anti-adherent material being a complementary extrusion;

FIG. 23 details a sectional view of the sealing member (FIG. 21) assembled with the anti-adherent material being a complementary extrusion (FIG. 22) both of which are installed between two surfaces with the sealing material;

FIGS. 24 and 25 detail respectively sectional views of the sealing member and an alternate detached anti-adherent material being a complementary extrusion;

FIG. 26 details a sectional view of the sealing member (FIG. 24) assembled with the alternate anti-adherent material being a complementary extrusion (FIG. 25) both of which are installed between two surfaces A and B with the sealing material;

FIGS. 27 and 28 detail respectively sectional views a sealing member and the said sealing member installed between two surfaces with the sealing material;

FIG. 29 and 30 each detail a sectional view of the sealing member installed as a component of a sealing assembly (combined with another sealing member); and FIG. 31 is a cross-sectional side view of an alternative sealing member having two outer limbs both of which have an anti-adherent surface.

Figure 1:
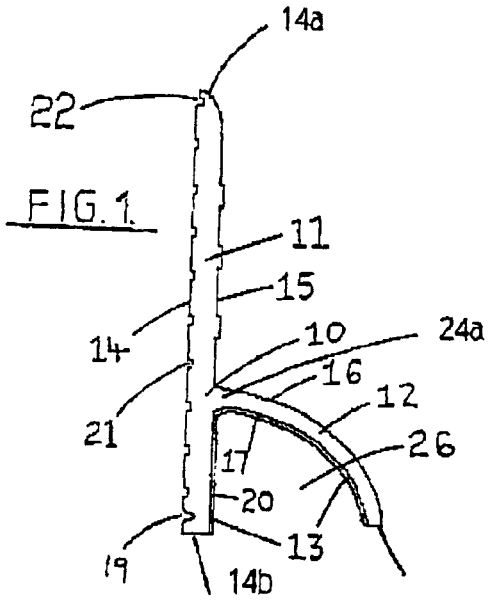
FIGS. 1 to 3 represent sectional views of three alternate embodiments of the sealing member according to the current invention.
Figure 2:
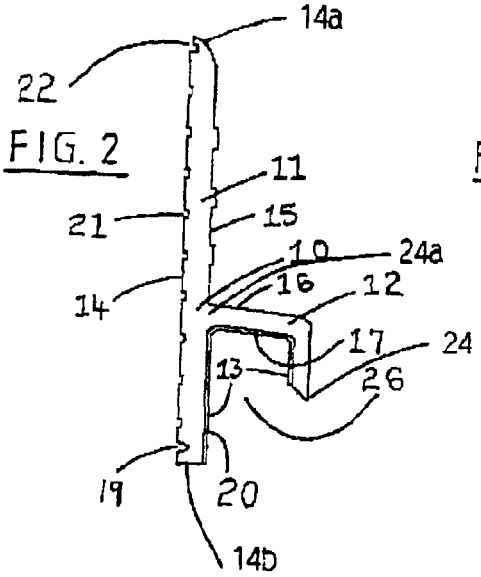

FIGS. 1 and 2 detail a section of the sealing member to which has a first upper limb 11 for contacting a generally vertical surface A, and a second outer limb 12 for containment of a sealing material 27 on the generally horizontal surface B.

The outer face 14 of the upper limb 11 has a series of recesses 21 to accommodate the gripping and storage of an adhesive sealant material 23.

The upper boundary 14*a* of outer face 14 of the upper limb 11 has a reservoir 22 to retain a sealant 23, while the lower boundary 14*b* of outer face 14 of the upper limb 11 is scored through rebate 19, to accommodate easy removal if required.

Extending outward from the inner face 15 of upper limb 11 is limb 12. The upper face 16 of outer limb 12 is directed downward to accommodate the flow of water, while the gap 25 between the outermost boundary line 24 of limb 12 and the horizontal surface B may be reduced through the removal of the lowermost part of limb 11, below the score line 19.

From the junction where the limb 12 meets upper limb 11 at inner boundary 24*a* of the limb 12, the sectional thickness of limb 12 is suitably reduced as it extends to the outer boundary 24 to allow movement in the event of surface A moving away from surface B. Limb 12 may be flexibly attached to limb 11 at the joint, to accommodate the retro-application of sealing material 27 into the cavity 26.

A continuous sealing material 27 may be fully or partially applied into the enclosed cavity 26. The boundary sides of this cavity 26 provide a form-work/shuttering or enclosure for the sealing material 27, the height and width of which may be dictated by the lower face profile 17 of limb 12, as desired The lower face 17 of limb 12, and/or the inner face part 20 of upper limb 11 are wholly or partially layered with an anti-adherent material 13. One such material is 100 micron polythene tape (FIG. 1) coated on one side with pressure sensitive adhesive that is applied against surfaces as required. Another such material is a complementary extrusion 61 and 62 in FIGS. 22 and 25 respectively.

The functions of the anti-adherent material 13 or 61 or 62 is to act as a layer or separator or shuttering between all or parts of the seal member 10 and the sealing materials.

In FIG. 1 the anti-adherent interface layer between the main seal member 10 and the sealing material 27 is polythene tape 13 which provides a low energy surface to which the sealant material, typically silicone 27, will not strongly adhere when cured. The tape may be applied wholly or partially onto the inner surfaces 20 and 17 defining the seal cavity 26.

The silicone 27 will form a strong bond with surface B, to create or aid the creation of a continuous 'boundary wall' on and over surface B, that will be releasably independent of the seal member, as the positioning of the anti-adherent materials 13, 61 or 62 may dictate.

Figure 4:
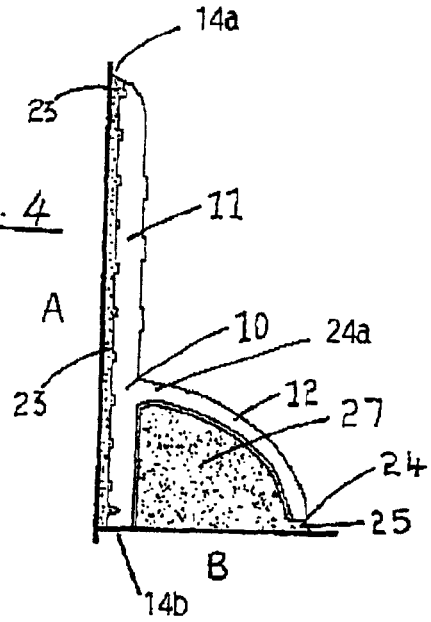
FIGS. 4 to 6 represent respectively sectional views the first three embodiments of the sealing member installed between two surfaces.
Figure 5:
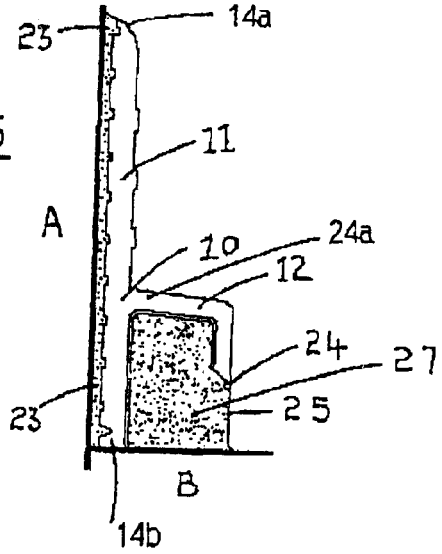
Figure 3:
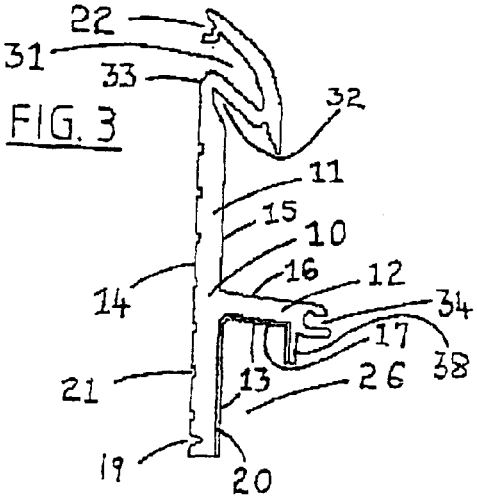
Figure 6:
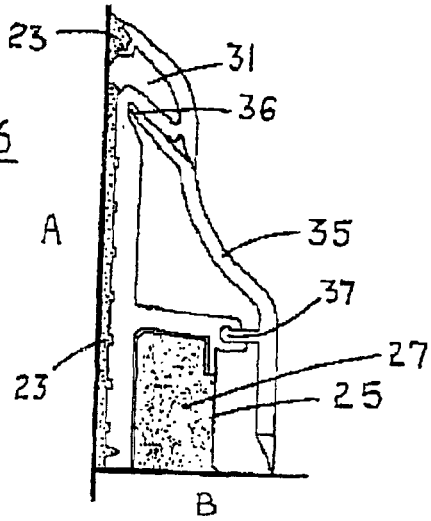

FIGS. 1 and 2 and their respective counterparts FIGS. 4 and 5 contain basically similar features. FIG. 3 and it's counterpart FIG. 6, detail a third embodiment according to the invention, whereby the sealing member is adapted to engage other seal members as desired.

In this embodiment the upper part 33 of limb 11 is adapted to retain in angle 32, the upper boundary 36 of a complementary seal member 35 and provide an overhanging sealant reservoir 31, while the outer part 34 of limb 12 is adapted to complementarily engage the clip-on leg detail 37 of said member 35.

The lower boundary 38 of limb 12 provides a track that determines the amount of sealant material 27 applied into the cavity 26 that is formed when the sealing member is installed over surface B.

Figure 7:
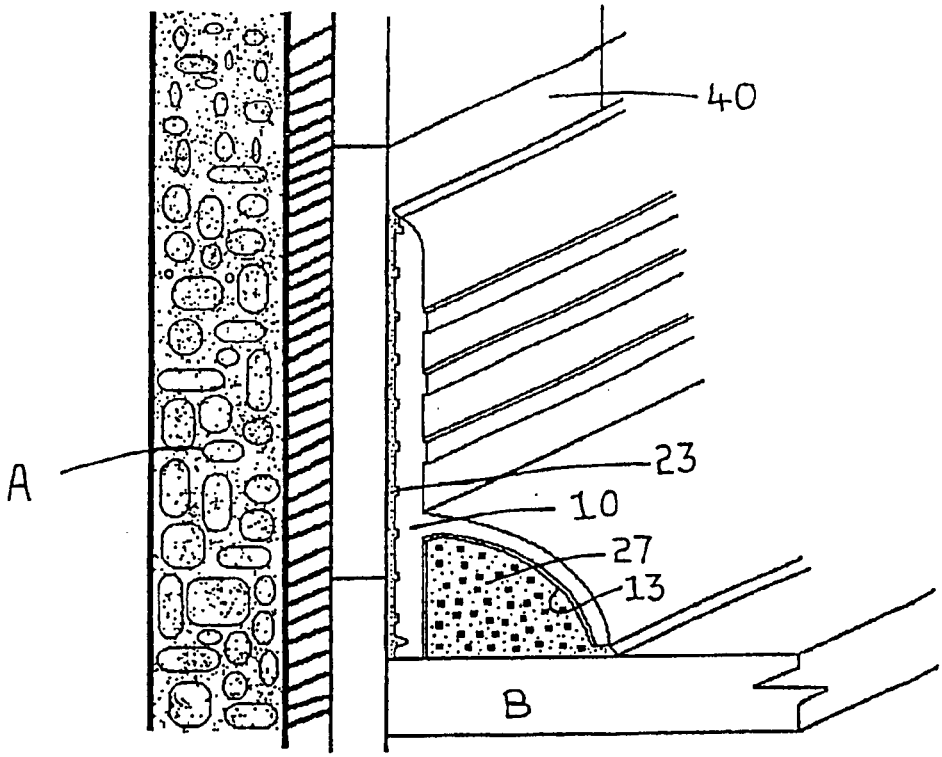
FIGS. 7 and 8 represent perspective views of the sealing profile detailed in FIGS. 1 and 4, whereby in FIG. 7 the seal is installed over tiles, and in FIG. 8 it is partially installed under tiles fixed to the wall.
Figure 8:
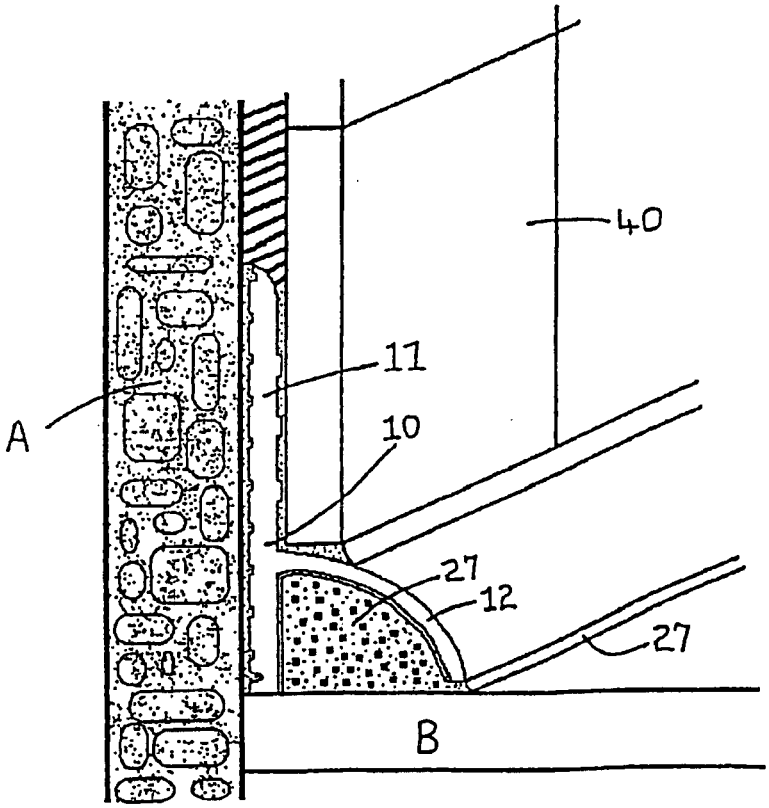

FIGS. 7 and 8 represent perspective views of the sealing profile detailed in FIGS. 1 and 4 whereby in FIG. 7 the sealing member 10 is installed over the tiles 40 with a adhesive/sealing material which may be typically though not exclusively silicone or a butyl rubber compound 23.

FIG. 8 details the sealing member 10 with the upper region of the upper limb 11 sandwiched between the vertical surface A and the tiles 40.

Figure 9:
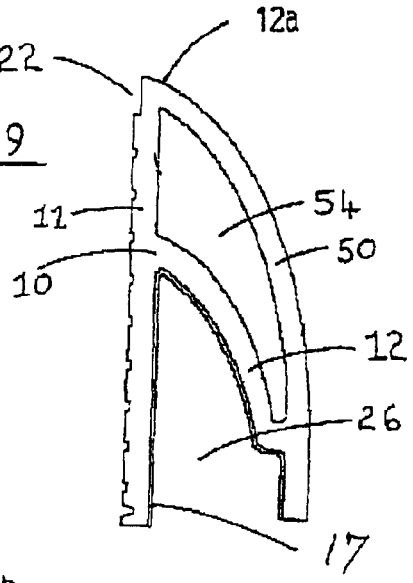
FIGS. 9, 10 and 11 represent sectional views of three further alternate embodiments of the sealing member according to the current invention.
Figure 12:
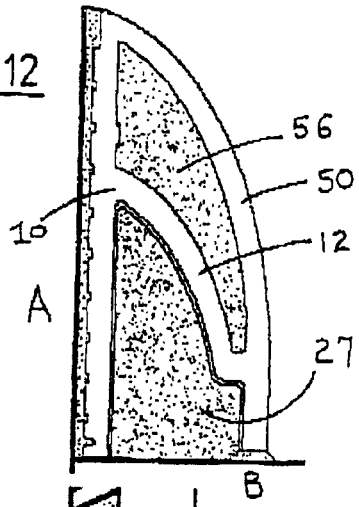
FIGS. 12, 13 and 14 represent respectively sectional views of FIGS. 9, 10 and 11 of the sealing member installed between two surfaces.

FIGS. 9 and 12 detail an embodiment whereby the upper most boundary 12*a* of the second limb 12 (part of which is limb 50), is attached to the first limb 11 to form a cavity 54 which may be filled with sealant 56 when seal members are joined together. The walls forming his cavity 54 may be wholly or partially layered with an anti-adherent material.

Figure 10:
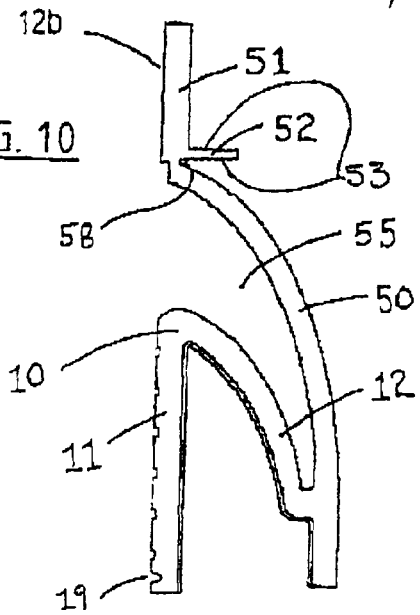
Figure 13:
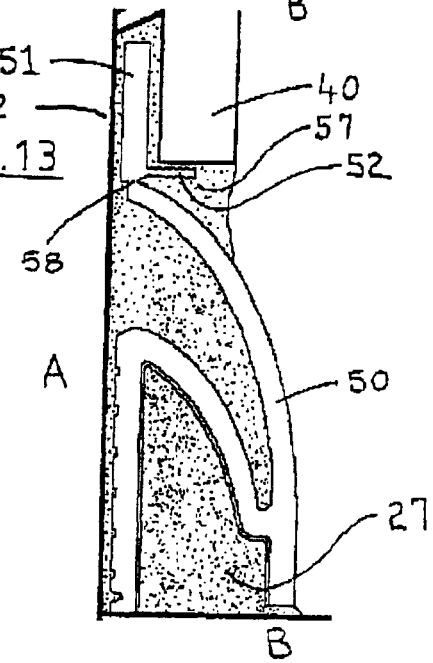

FIGS. 10 and 13 detail an embodiment whereby upper most boundary 12*b* of the second limb 12 (part of which is limb 50), is unattached to the first limb 11, but adapted to be engaged between a vertical surface A and wall covering 40 through limb 51, which in itself is adapted through limb 52, to support the said wall covering.

The upper and lower faces of limb 52 are ribbed to encourage the strong adherence of sealant 57. The joint between limb 50 and the attached limbs 51 and 52 is weakened at 58 to enable the easy detachment when the seal member is being installed over the wall covering.

Figure 11:
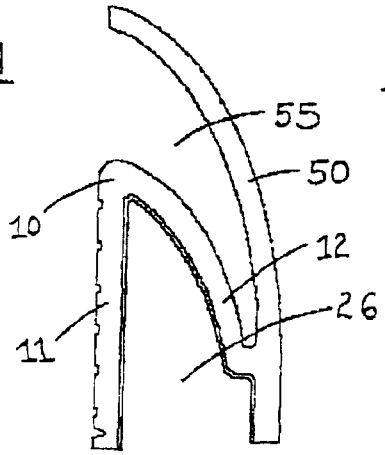
Figure 14:
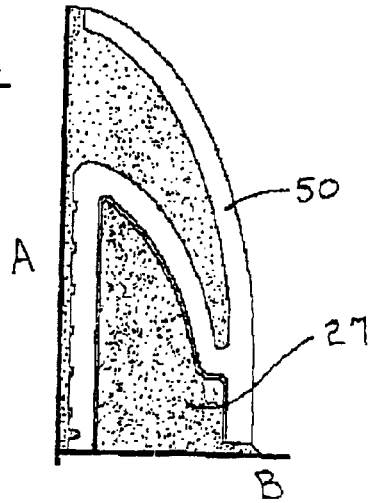

FIGS. 11 and 14 detail respectively the seal member described in FIGS. 10 and 13, but in a surface mounted application, without limbs 51 and 52 attached.

FIG. 15 details a sectional profile of a seal member 10 wherein a second outer limb 63 is introduced to conserve the volume of sealing material 27 used. The anti-adherent material in this detail is a polythene tape 13. The uppermost surface of the seal cavity 81 is not layered with the polythene tape 13 allowing the sealing material 27 form a bond with this section.

FIG. 18 is a sectional detail of FIG. 15 when installed between two surfaces A and B.

This is a behind tile installation wherein the tiles 40 are fixed over the upper limb 11.

FIGS. 16 details a sectional profile of a seal member 10. The anti-adherent material is a polythene tape 13. The uppermost surface of the seal cavity 83 is not layered with the polythene tape 13 allowing the sealing material 27 form a bond with this section.

FIG. 19 is a sectional detail of FIG. 16 when installed between two surfaces A and B. This is a behind tile installation wherein the tiles 40 are fixed over the upper limb 11.

FIGS. 17 details a sectional profile of a seal member 10. The anti-adherent material is a polythene tape 13. The uppermost surface of the seal cavity 84 is not layered with the polythene tape 13 allowing the sealing material 27 form a bond with this section.

FIG. 20 is a sectional detail of FIG. 17 when installed between two surfaces A and B.

This is a surface installation wherein the upper limb 11 is fixed over the tiles 40.

FIGS. 21 and 22 are sectional details of the main seal member 10 and a complementary anti-adherent extrusion material 61 respectively. The outer limb 12 is connected to the lower boundary of the upper limb 11. In this detail the detached anti-adherent extrusion is the layer and shuttering separating a sealing material 27 from the main seal member 10.

FIG. 23 is a sectional detail of FIGS. 21 and 22 when assembled and installed between two surfaces A and B. In this installation the complementary anti-adherent extrusion material 61 is installed prior to the main seal member 10. This detail and installation method has the advantages of executing the installation in step by step phases to suit the DIY installer.

FIGS. 24 and 25 are sectional details of the main seal member 10 and a complementary extrusion 62 respectively. In this detail the extrusion 62 is used; (a) as an anti-adherent and shuttering material for the sealant (b) as a complementary sealing material use with a sealant (c) as a profile adapted to conserve sealant.

When joining one anti-adherent extrusion 62 to another, or capping ends, the extrusion cavity 85 is filled solid with sealant 27, in this case the extrusion 62 is performing in part as an anti-adherent layer and/or shuttering, separating a sealing material 27 from the main seal member 10.

When the extrusion 62 cavity 85 is not filled solid with sealant, typically along areas not adjacent to jointed or capped ends, the curved limb 86 of the extrusion 62 is in effect performing as a sealing limb preventing the penetration of liquid into the cavity 85.

The extrusion 62 is adapted to conserve an un-necessitated volume of sealant material through the provision of lower face limbs 66 and 67 defining a longitudinal channel 64 along its lowermost face, restricting the ingress of sealant into the cavity 85.

The adaptation of providing channel 64 also permits the continuous unbroken passage of sealing material 27 from surface B into the cavity 85 of extrusion 62. This is critical when joining two extrusions together or capping an end. Channel 64 also aids the bond between the extrusion 62 and the surface B.

In cases where it is desired to adjust the profile of extrusion 62 to compensate for instances where surface B is tilted down (bath ledges), the lower boundary section 65 may be torn off extrusion 62 along the weakening recess 68.

The lowermost limbs 66 and 67 defining the channel may be splayed upward to accommodate the passage of excess sealing material 27 into the cavity 85 during installation. These lowermost faces 66 and 67 may be fluted or otherwise adapted (not shown) to encourage a good key or bond with the sealing material 27

FIG. 26 is a sectional detail of FIGS. 21 and 22 when assembled and installed between two surfaces A and B. In this installation the complementary extrusion material 62 is installed prior to the main seal member 10 and so this detail and installation method has the advantages of not only executing the installation in step by step phases, but saves sealing material.

It should be understood that many variations and adaptations of the main seal members 10 and the complementary anti-adherent/shuttering extrusions (like 61 and 62) are possible.

In FIGS. 21 through to 26, the introduction of an extrusion (61, 62) to act as an anti-adherent and/or sealing material is to aid and segment installation, in particular for the DIY enthusiast who may not be proficient in the speedy application of sealants.

FIGS. 27 and 28 are profile variation similar to those described for FIGS. 17 and 20.

FIG. 29 details a sectional view of a sealing assembly wherein a first complete seal 70 similar to FIG. 16, is combined with a complementary second complete seal 80, and installed over an expansion joint between surfaces C and D. The surfaces C and D are in line and parallel, and could reflect either two meeting tiled wall structures or two meeting tiled floor slabs. The sealing material 27 is applied into the combined cavity through channel 74 and may later be capped (not shown).

FIG. 30 details a sectional view of a sealing assembly wherein a first complete seal 90 is combined with a second complete seal 91 over an expansion joint between surfaces E and F. The surfaces E and F are at right angles, and could reflect either two meeting tiled wall structures or a tiled wall meeting tiled floor slabs. The sealing material 27 is applied into the combined cavity through corner channel now capped by extrusion 88. In this detail the seal members are interconnected by a flexible material 87.

FIG. 31 details a section of a sealing member upper main limb 110 with an upper boundary 111 and a lower boundary 112 between where there extends first face 113 and a second face 114. Extending from the main limb first 113 and second 114 faces are a first outer limb 115 and a second outer limb 116 respectively.

The first outer limb 115 and a second outer limb 116 are adapted to be easily removed from the main upper 110 through the weakening recesses 117 and 118 respectively. The height of the main limb 110 may be reduced through the easy removal of longitudinal sections typically defined by weakening recesses 119 and 120 in the main limb.

The first 113 and second 114 main limb faces are adapted to retain a sealing/adhesive material through ribs 121 and recesses 122. The profile of the upper faces 123 and 124 of the outer limbs 115 and 1 16 respectively are adapted to throw off liquid. The profile of the lower faces 125 and 126 of the outer limbs 115 and 116 respectively are adapted to accommodate and retain a sealing material.

The lower faces of the outer limbs 115 and 116 are partially layered with anti-adherent membranes 129 and 130 respectively. The main upper limb 110 is partially layered with anti-adherent membranes 131 and 132 on the first 113 and second 114 faces respectively.

The purpose of layering the surfaces 129, 130, 131 and 132 with an anti-adherent material is to form a releasable shuttering for sealing material that may be applied into the cavities 135 and 136 formed between the outer limbs 115 and 116, their respective main upper limb 110 first 113 and second 114 faces and their respective adjacent horizontal surface B, thereby providing continuous up-standing containment cavities 135 and 136 respectively for the applied sealant that will form a boundary wall, bonded to the horizontal surface B, yet wholly or partially independent and/or releasable from the seal member to which initially attached.

Typical locations for this seal in are in shower bath enclosures, kitchen worktops, wherein the seal is installed longitudinally onto wall over the joint created by the respective ledges and their adjacent walls.

A typical installation method will now be briefly described, taking by way of example, a shower tray installation and relate to two seal embodiments.

(1) The first installation method relates to the seal member embodiment incorporating the pre-attached anti-adherent polythene tape (FIGS. 15 to 20).

(2) The second installation method relates to the seal member embodiment incorporating a complementary extrusion employed both as an anti-adherent material and part sealing material adapted to reduce the use of sealant (FIGS. 24 to 26).

METHOD 1

Measure and cut seal members to the lengths as required (usually three lengths per shower pan or bath), allowing mitre cuts butt joints in comers. Taking the first seal member to be installed, fix it upside down (mechanically) and slightly overfill the seal cavity with sealant. Lay a bead of sealant on the respective wall midway behind the proposed location of the seal member. Take the sealant filled seal member and offer it into it's proposed location, press it simultaneously against the wall and ledge, squeezing out the sealant. Fill any voids with sealant prior to pressing seal member home. Remove surplus sealant and continue installation accordingly, insuring sealant runs solid throughout comers and open ends are capped with sealant.

METHOD 2

Step 1. Measure and cut anti-adherent extrusions to the lengths as required (usually three lengths per shower pan or bath), allowing mitre cuts in butt joints in comers. Taking the first anti-adherent extrusion to be installed, hold it upside down, slightly overfill the lower face with sealant. Take the sealant filled anti-adherent extrusion and offer it onto it's proposed location, press it down onto the ledge, squeezing out the sealant. Fill the ends solid with sealant. Remove surplus sealant. Continue installing anti-adherent extrusion accordingly, insuring sealant runs solid throughout comers and open ends are capped with sealant.

Step 2. Measure and cut complementary seal members to the lengths as allowing mitre cuts for butt joints in comers. Lay a bead of sealant above anti-adherent extrusion on the respective wall midway behind the proposed location of the seal member. Take the seal member and offer it against it's proposed location, press it simultaneously against the wall, squeezing out the sealant. Remove surplus sealant. Continue installation accordingly. Apply a bead of sealant over but jointed seal members and rub smooth.

It is to be understood that the invention is not limited to the specific details described herein which are given by way of example only and that various modifications and alterations are possible without departing from the scope of the invention as defined in the appended claims.

What is claimed is:

1. A sealing member for maintaining a sealed joint between relatively vertical and horizontal surfaces, being either straight linear or corner joints, the sealing member comprising:

a scaling material;

a first substantially rigid limb having an upper boundary and lower boundary between which there extends on each side of the first limb an inner face and an outer face, the outer face of which can be fixed or sealed to the relatively vertical surface, and from which inner face, upper boundary or lower boundary there extends at least one second substantially rigid limb having an inner boundary and an outer boundary, the inner boundary of which is attached to the inner face or lower boundary of the first limb, and between which inner and outer boundaries there extends on each side of the second limb an upper face and a lower face, the lower face, a predetermined portion of which can be sealed to the relatively horizontal surface, and to accommodate and retain the sealing material between the second limb lower face and the horizontal surface, characterized in that a predetermined portion of the one of first limb inner face and the second limb lower face is layered with an anti-adherent material to form a releasable shuttering for the sealing material in the cavity formed between the first limb inner face and the second limb lower face and the adjacent horizontal surface, thereby providing a continuous up-standing containment cavity for the applied sealing material that will form a boundary wall bonded to the horizontal surface, a predetermined portion of the boundary wall being independent and releasable from the seal member to which initially attached.

2. A sealing member as claimed in claim 1, wherein the anti-adherent material is a polythene tape, an anti-stick film spray, a co-extruded material, or a complementary extrusion.

3. A sealing member as claimed in claim 2 wherein the sealing material is a silicone, a complementary extrusion, a butyl tape or a sealant material.

4. A sealing member as claimed in claim 1, wherein the anti-adherent material is a polythene tape coated on one side with a pressure sensitive adhesive that bonds the polythene tape onto surfaces of the sealing member to prevent the formation of a bond between the sealing material and the portion of the surface of the sealing member bonded with the anti-adherent material.

5. A sealing member as claimed in claim 1, wherein the anti-adherent material is an extrusion that is layered against the sealing member to form a shuttering between the sealing material and those surfaces of the scaling member desired not to form a bond with the sealing material.

6. A sealing member as claimed in claim 1, wherein an extrusion is employed simultaneously as a part sealing material and an anti-adherent material.

7. A sealing member as claimed in claim 1, wherein one of the first and second limbs of the sealing member drains off water that may fall there on, the one of the first and second limbs of the sealing member for engaging complementary sealing members.

8. A sealing member as claimed in claim 7, wherein the outside face of the first limb has a plurality of one of ridges and recesses and contact points and holes to accommodate one of fixing and sealing adhesive materials.

9. A sealing member as claimed in claim 1, wherein the connection between the first limb and the second limb flexibly accommodates the retro-application of a sealing material one of under and behind the second limb, the connection between the first limb and the second limb flexibly accommodates lateral movement of the sealing material away from the first limb.

10. An assembly of two sealing members as claimed in claim 1 wherein the two sealing members are interconnected and complementarily profiled to seal the joint between two adjacent surfaces.

* * * * *